US009346617B1

(12) United States Patent
Griffin

(10) Patent No.: US 9,346,617 B1
(45) Date of Patent: May 24, 2016

(54) DEVICE TO DISPENSE A DEODORIZING AGENT IN A TRASH COMPACTOR

(71) Applicant: Noah Griffin, Jacksonville, FL (US)

(72) Inventor: Noah Griffin, Jacksonville, FL (US)

( * ) Notice: Subject to any disclaimer, the term of this patent is extended or adjusted under 35 U.S.C. 154(b) by 482 days.

(21) Appl. No.: 14/054,911

(22) Filed: Oct. 16, 2013

(51) Int. Cl.

| | |
|---|---|
| ***B30B 15/30*** | (2006.01) |
| ***B65F 7/00*** | (2006.01) |
| ***B65F 1/14*** | (2006.01) |
| ***B30B 9/30*** | (2006.01) |

(52) U.S. Cl.
CPC ..... *B65F 7/00* (2013.01); *B30B 9/3017* (2013.01); *B65F 1/1405* (2013.01)

(58) Field of Classification Search
CPC ..... B65F 7/00; B65F 1/1405; B30B 9/3003; B30B 9/3017; E03D 9/005; E03D 9/007; E03D 2009/024; B29C 31/02; B65D 88/28; B65D 88/54
USPC ..... 100/45, 71, 73; 220/87.1
See application file for complete search history.

(56) References Cited

U.S. PATENT DOCUMENTS

| | | | | | |
|---|---|---|---|---|---|
| 2,747,201 | A * | 5/1956 | Herriott | E03D 9/04 | 4/213 |
| 3,613,561 | A * | 10/1971 | Difley | B30B 9/3064 | 100/229 A |
| 3,636,862 | A * | 1/1972 | Bottas | B30B 9/3017 | 100/229 A |
| 3,926,107 | A * | 12/1975 | Dunlap | A61L 11/00 | 100/215 |
| 4,047,775 | A * | 9/1977 | Wolbrink | B30B 9/3017 | 100/229 A |
| 4,068,575 | A * | 1/1978 | Difley | B30B 9/3017 | 100/229 A |
| 4,235,849 | A * | 11/1980 | Handeland | B01F 1/0027 | 166/75.15 |
| 4,694,846 | A * | 9/1987 | Bouchard | B65F 7/005 | 134/115 R |
| 4,719,851 | A * | 1/1988 | Chesnut | B30B 9/3017 | 100/229 A |
| 4,989,506 | A * | 2/1991 | McCormick | B30B 9/3017 | 100/229 A |
| 5,448,945 | A * | 9/1995 | Taylor | B30B 9/3042 | 100/100 |

* cited by examiner

*Primary Examiner* — Jimmy T Nguyen
(74) *Attorney, Agent, or Firm* — Lawrence J. Gibney, Jr.

(57) ABSTRACT

This device will help to eliminate or greatly reduce the odor in a compactor that is caused by garbage and rotting waste. This, in turn, will help eliminate the amount of flies and/or maggots which surround a compactor because the smell, which attracts flies will be reduced. A predetermined amount of deodorizing pellets are distributed in a compactor at predetermined times.

4 Claims, 5 Drawing Sheets

DEVICE TO DISPENSE A DEODORIZING AGENT IN A TRASH COMPACTOR

BACKGROUND OF THE INVENTION

A. Field of the Invention

This relates to deodorizing certain compactors and dumpsters that can be sources of extremely offensive odors. This device will be automatic and install on the side of a compactor and distribute a predetermined amount of deodorizing pellets on the bottom surface of the compactor.

B. Prior Art

There are many other prior art references to the deodorizing agent as well as to the actual compactor. Neither the deodorizing agent nor the compactor is being claimed as part of this invention, but it will be referred to in terms of the application.

Several prior art references can be found including Wolbrink, U.S. Pat. No. 4,047,775. This is a deodorizer for trash compactors. In Wolbrink, a vapor is released into the compactor to mask odors which come from compacted trash. In this case, pellets are used which are evenly distributed on the bottom surface of the compactor.

Another representative example in the prior art can be found at Difley, U.S. Pat. No. 4,068,575, which is a compactor with a selective spray device. The spray device emits a are distributed on the bottom surface of the compactor to deodorize the contents of a compactor or dumpster.

BRIEF SUMMARY OF THE INVENTION

Compactors and dumpsters have been used to store large quantities of waste material. Unfortunately, as the waste material decomposes, it produces odors in addition to the odor that is already found in the waste material. This produces offensive odors. These offensive odors can be found in these types of containers.

This is a device that will be housed in two sections, which are both attached to the side of the compactor.

One section will be comprised of a hopper that contains a predetermined amount of deodorizing pellets. A valve and a air line will be positioned on the bottom of the hopper to allow the deodorizing pellets to exit the hopper and be distributed on the floor of the compactor. A hole in the side of the compactor will accommodate the opening with the hopper. A small valve, probably a gate valve, in the bottom of the hopper will be operated in order to dispense the pellets with a blast of air that flows through an air nozzle and will distribute the pellets on the bottom of the compactor.

Another section will consist of a housing that will contain various components to include an air compressor, an air tank, a relay, a timer and a fuse. A power supply will also be connected to this housing. The power supply will likely be linked to the power supply for the compactor. The air tank will be able to store a sufficient amount of air under pressure and this air will be released through tubing and through the air nozzle on the bottom of the hopper. The casing will also contain appropriate fuses or safeguards to prevent damage to the components of the device.

A timer that is contained in the housing will allow the pellets to be distributed on a certain schedule. It is anticipated that the unit will operate based on the particular needs of the customer.

The device is meant to be as automatic and as hands free as possible.

The deodorizing pellets are sprayed into the bottom of a dumpster or compactor. As the compactor blade moves along the bottom surface, the pellets will be distributed throughout the bottom surface of the compactor and crushed for even greater results.

NUMBERING DESCRIPTION

Figure 1:
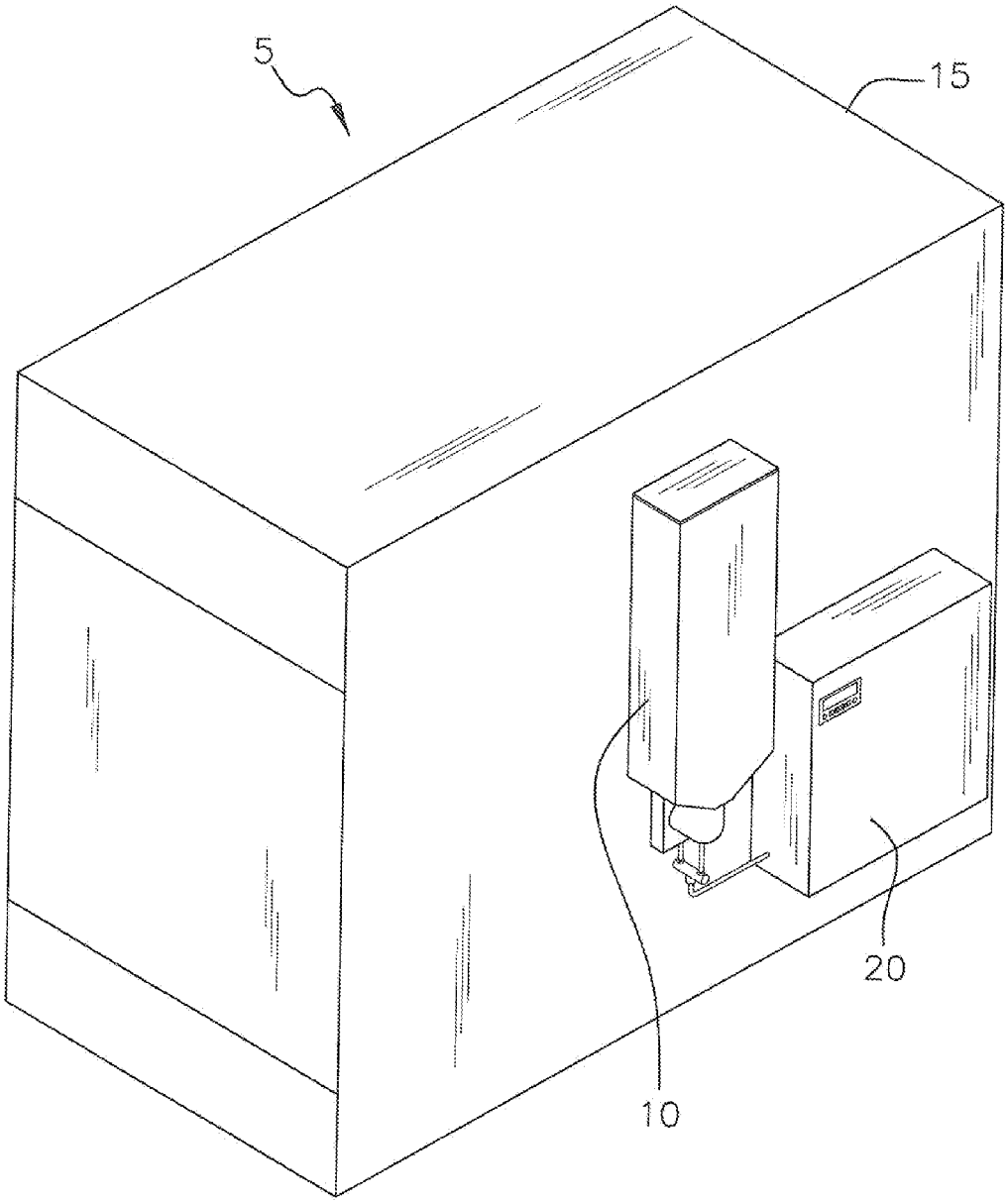
FIG. 1 is an isometric view of the hopper and casing attached to the side of the compactor.
Figure 2:
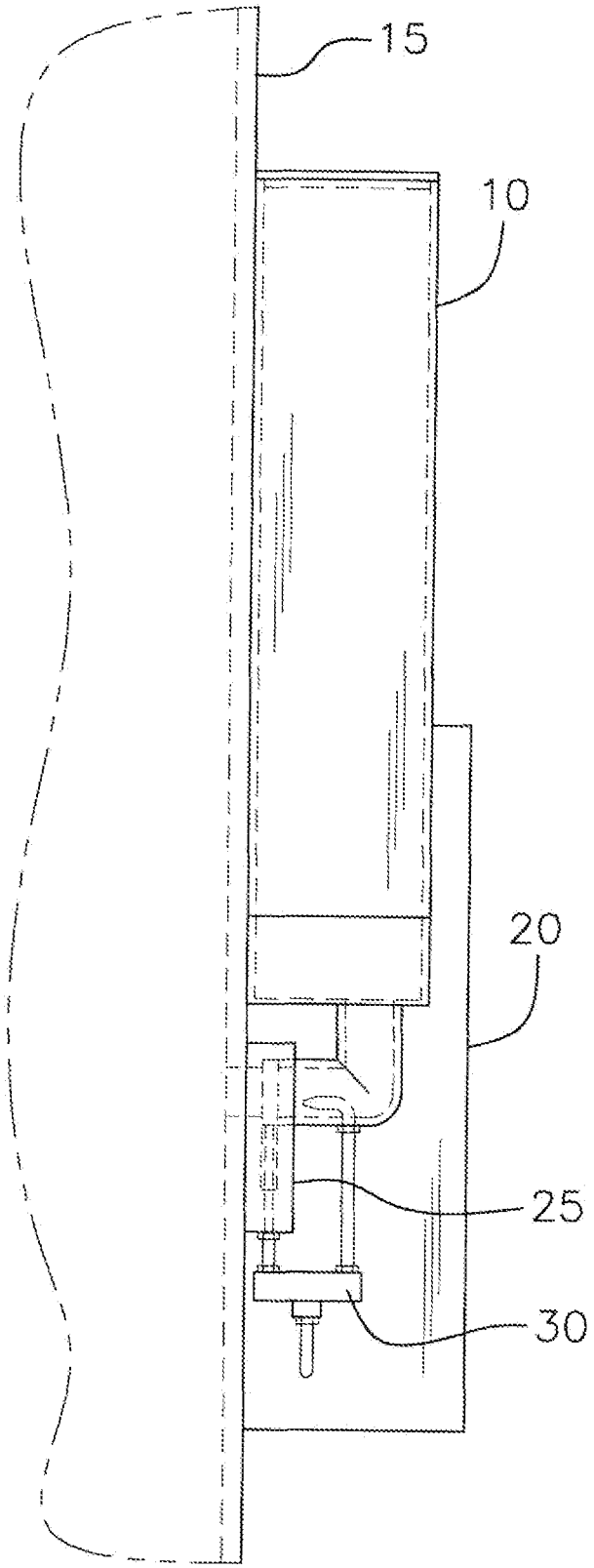
FIG. 2 is a side view of the hopper and casing attached to the side of the compactor.
Figure 3:
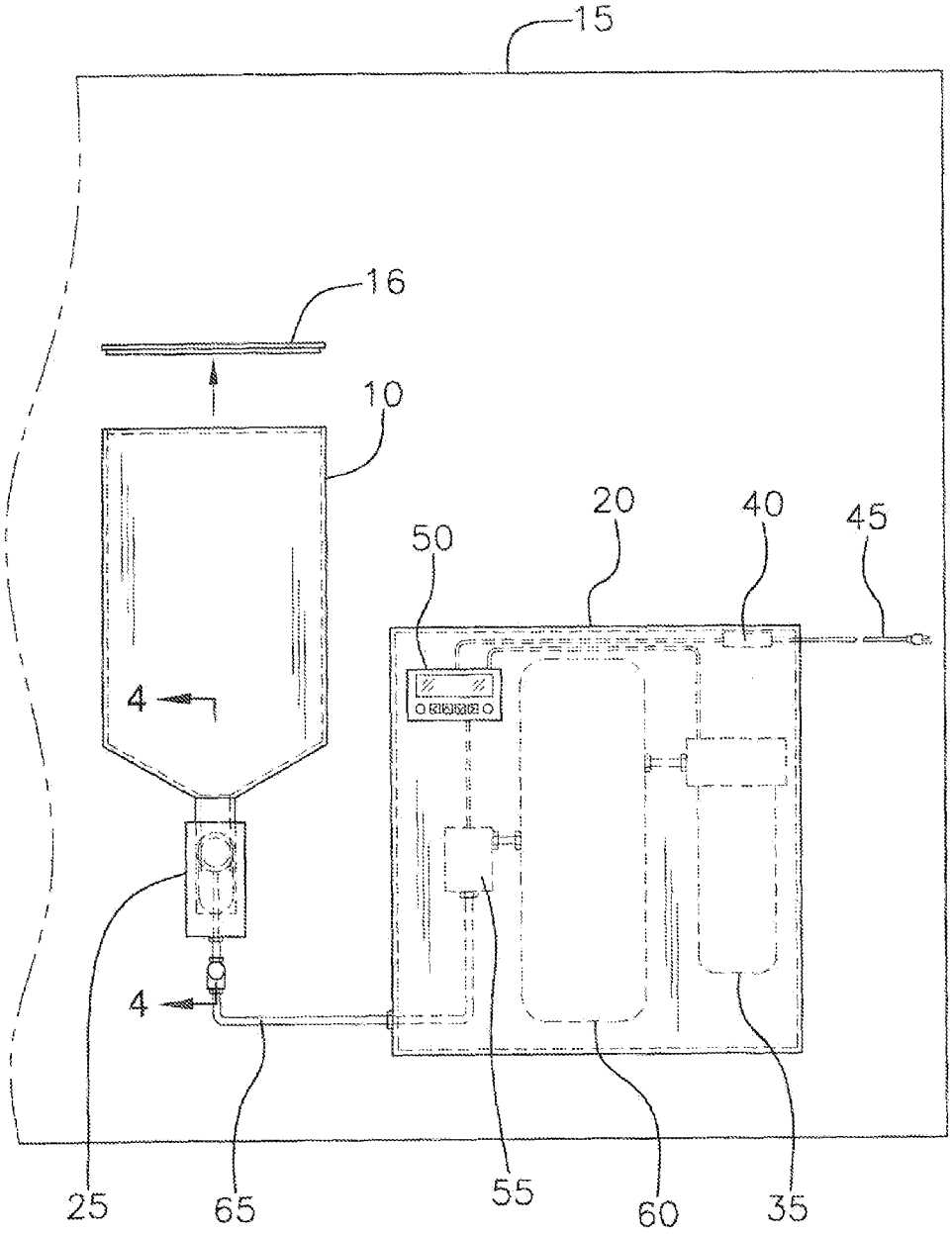
FIG. 3 is a front view of the casings showing the components of the device within the casing in dashed lines.
Figure 4:
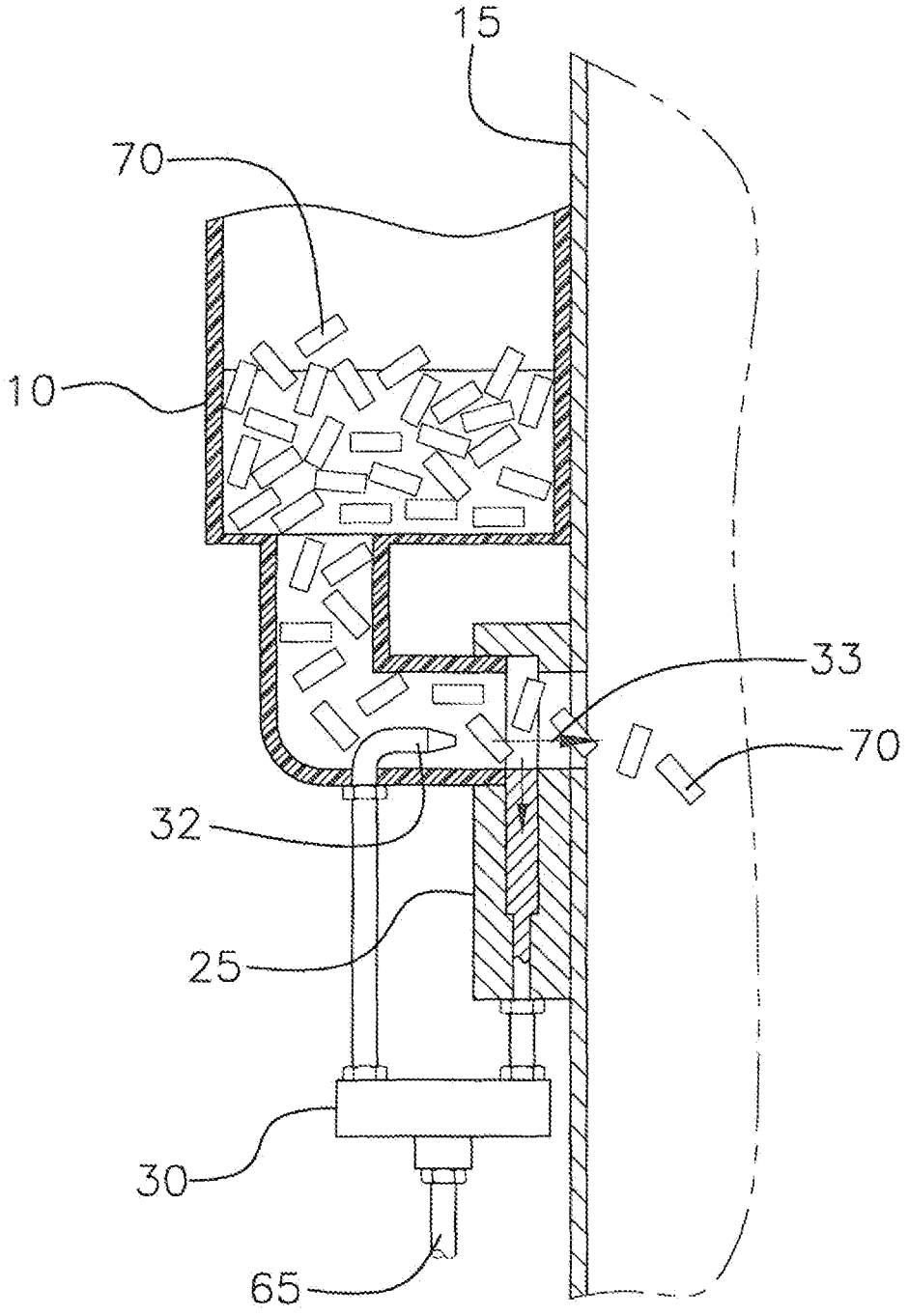
FIG. 4 is a view according to line 4-4 on FIG. 3.
Figure 5:
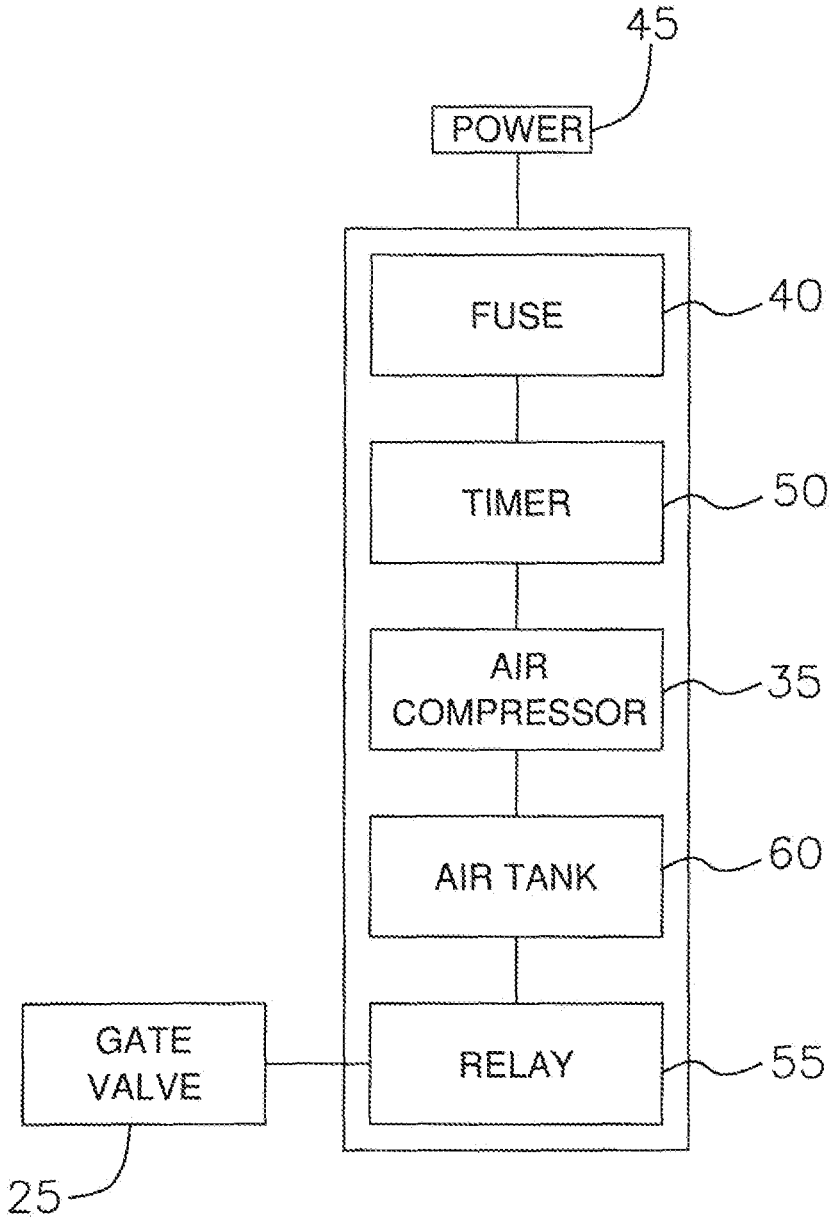
FIG. 5 is a schematic of the components of the device.

5—Device
10—Hopper
15—Compactor
16—Lid
20—Air Compressor Housing
25—Valve
30—Air Splitter
32—Air Nozzle
33—Air Flow
35—Air compressor
40—Fuse
45—Power supply
50—Timer
55—Relay
60—Air Tank
65—Air Hose
70—Deodorizer Pellets

DETAILED DESCRIPTION OF THE EMBODIMENTS

Garbage or waste material is fed into one end of a compactor and a blade which is attached to a cylinder inside the compactor compresses the items at predetermined intervals. When the compactor is full or nearly full, a truck will typically take the compactor with the waste material to the appropriate waste facility such as a landfill.

During the interim, however, the waste material from the compactor will emit offensive odors because of the waste and decay that is occurring in the compactor. This device 5 will allow the compactor 15 to become deodorized between the time that it is empty and the time that it is full and taken to the landfill.

The compactor 15 will have its own power supply and this will be linked to the power supply for the device 5 and this power supply operates the blade of the compactor as well as controlling the operation of the compactor. This device 5 will be linked to the power supply of the compactor and therefore does not rely on any outside source such as the building power supply.

The electrical system of the compactor will operate the compactor blade as well as determine the cycles during which the compactor blade will compact the trash. Depending on the amount of trash and the type of trash, the blade of the compactor may circulate one to three times or even more to compact the waste material.

In many compactors, there is an electrical eye or some sort of automatic feature which will signal the compactor to begin and end the compaction process.

One of the biggest challenges with this type of container that holds waste including food is preventing the elimination of odor from the decaying trash material. This is particularly true of compactors that store food or waste items. A lack of odor will significantly reduce, if not eliminate, flies or other pests that circulate around compactors. Without flies, there would be no maggots which make for an incredibly uncomfortable experience.

This device will be tied electrically with the electric supply for the compactor power pack. The power pack will operate independently of the device but will, indeed, power this device. This device 5 will consist of a two separate housings that will both attach to the side of the compactor 15.

A hole will need to be made in the side of the compactor 15 to provide a means to permit the deodorizing pellets 70 that are in the hopper 10 to be distributed into the compactor 15.

One part of the device will be the hopper 10 that will contain the deodorizer pellets 70. A lid 16 on the top of the hopper 10 will provide a means to add more deodorizing pellets 70 into the hopper 10. The deodorizing pellets 70 themselves are not being claimed but are integral to the operation of the device.

At the bottom of the hopper 10 a valve 25 and an air nozzle 32 are installed near an opening in the bottom of the hopper. Although there are many ways to operate the valve 25, which is likely to be a gate valve a pneumatically operated valve is depicted in the figures; alternatively the valve may also be operated electronically. An air splitter 30 will allow the valve 25 and a burst of air through the air nozzle 32 to operate together to assist the distribution of the deodorizing pellets 70 within the interior of the compactor 15. A hose or tube 65 will provide a means for the source of air to operate the valve 25 and provide the air flow 33 to distribute the pellets 70.

The air compressor housing 20 will also be attached to the side of the compactor 15 in close proximity to the hopper 10. During normal operation the air compressor 20 housing will remain closed to protect the internal components.

Inside the air compressor housing 20 will be an air compressor 35, a relay 55, a timer 50, an air tank 60 and an appropriate electric safeguard such as a fuse 40 in addition to the power supply 45. The timer will be configured to operate in conjunction with the operation of the compactor using the compactor's own power supply.

The timer 50 can be preset to determine the amount of distribution of the deodorizer pellets by regulating the amount of time that the valve 25 remains open to determine the appropriate quantity of deodorizer pellets 70 to be distributed.

The relay 55 controls the operation of the valve 25 opening and the timing of the burst of air through the nozzle 32.

During normal operation a small source of compressed air will be released through the air nozzle 32 that will force the granules of odor-abating material or deodorizing pellets 70 onto the floor of the compactor. The deodorizing pellets 70 on the compactor floor will be moved and crushed by the compactor blade to insure that the deodorizing pellets can be distributed along the entire floor surface of the compactor for maximum effect.

In subsequent compacter cycles, the compactor blade would then scrape against the bottom of the floor and distribute the granules along the bottom surface as well as pulverizing them.

The timing of the distribution of the pellets will be predetermined or preset.

It is anticipated that the hopper 10 which houses the deodorizing pellets 70 will permit distribution of somewhere in the range of one-half ounce during each cycle which will be sufficient to combat most odor problems although that amount can be adjusted depending on the circumstances and depending on the particular odors being addressed.

While the embodiments of the invention have been disclosed, certain modifications may be made by those skilled in the art to modify the invention without departing from the spirit of the invention.

The inventor claims:

1. A device to dispense a deodorizing agent in a trash compactor which is comprised of:

a. a trash compactor;
  wherein the trash compactor is of a predetermined size;
b. a hopper;
  wherein the hopper is of a predetermined shape and size;
  said hopper is secured to the side of the compactor;
  wherein a hole is made in the compactor to accommodate an opening on a bottom of the hopper;
  wherein a lid is provided on the top of the hopper;
c. a valve;
  wherein a valve is positioned at the bottom of the hopper;
d. an air supply line;
  wherein an air supply line is connected to the bottom of the hopper in close proximity to the valve;
e. an air splitter;
  wherein the air splitter controls the flow of air to an air nozzle and the valve;
f. an air compressor;
  wherein the air compressor provides a source of air;
g. an air tank;
  wherein the air tank stores a predetermined amount of air;
h. a timer;
i. a relay;
j. an electrical safeguard;
k. a power supply; and
l. deodorizing pellets;
  wherein deodorizing pellets are provided;
  said deodorizer pellets are placed in the hopper;
  said deodorizer pellets are distributed into the compactor.

2. The device as described in claim 1 wherein the valve is a gate valve.

3. The device as described in claim 1 wherein the valve is pneumatically operated.

4. The device as described in claim 1 wherein the valve is electrically operated.

* * * * *